US007143729B2

(12) United States Patent
Yaoko et al.

(10) Patent No.: US 7,143,729 B2
(45) Date of Patent: Dec. 5, 2006

(54) VALVE TIMING REGULATING APPARATUS WITH IMPROVED PHASE CONTROL RESPONSE

(75) Inventors: Seiji Yaoko, Nishio (JP); Jun Yamada, Nishio (JP); Takao Nojiri, Anjyo (JP)

(73) Assignees: Nippon Soken, Inc., Nishio (JP); Denso Corporation, Kariya (JP)

( * ) Notice: Subject to any disclaimer, the term of this patent is extended or adjusted under 35 U.S.C. 154(b) by 29 days.

(21) Appl. No.: 10/950,507

(22) Filed: Sep. 28, 2004

(65) Prior Publication Data

US 2005/0066923 A1 Mar. 31, 2005

(30) Foreign Application Priority Data

Sep. 30, 2003 (JP) ..... 2003-339948

(51) Int. Cl.
*F01L 1/34* (2006.01)

(52) U.S. Cl. ..... 123/90.17; 123/90.15; 464/160

(58) Field of Classification Search ..... 123/90.16, 123/90.17, 90.18, 90.27, 90.31, 90.15; 464/1, 464/2, 160

See application file for complete search history.

(56) References Cited

U.S. PATENT DOCUMENTS 6,250,265 B1 * 6/2001 Simpson ..... 123/90.17

FOREIGN PATENT DOCUMENTS

EP 1 286 023 A2 2/2003
JP A 2003-106115 4/2003

* cited by examiner

*Primary Examiner*—Thomas Denion
*Assistant Examiner*—Ching Chang
(74) *Attorney, Agent, or Firm*—Nixon & Vanderhye, P.C.

(57) ABSTRACT

A supply switching valve (140) can selectively switch the communication between a supply path (104) and a retard supply path (110) and the communication between the supply path (104) and an advance supply path (120). Check valves (111, 121) are arranged in the retard supply path (110) and the advance supply path (120), respectively. The check valves (111, 121) allow the working oil to be supplied from an oil pump (102) to each oil pressure chamber and prohibit the reverse flow of the working oil from each oil pressure chamber to the oil pump (102). A discharge switching valve (150) is configured independently of the supply switching valve (140) and can selectively switch the communication between a retard discharge path (130) and a discharge path (134) and the communication between an advance discharge path (132) and the discharge path (134).

12 Claims, 14 Drawing Sheets

VALVE TIMING REGULATING APPARATUS WITH IMPROVED PHASE CONTROL RESPONSE

BACKGROUND OF THE INVENTION

1. Field of the Invention

The present invention relates to a valve timing regulating apparatus for changing the open/close timing (hereinafter referred to as "the valve timing") of at least one of an intake valve and an exhaust valve of an internal combustion engine in accordance with the operating conditions thereof.

2. Description of the Related Art

A known conventional valve timing regulating apparatus comprises a driving rotary member for receiving the drive force of a crankshaft of an internal combustion engine and a driven rotary member for transmitting the drive force of the crankshaft to a camshaft, wherein the driven rotary member is rotatively driven relatively with respect to the driving rotary member, to a retard side and an advance side, by the working fluid pressure of retard chambers and advance chambers thereby to regulate the phase of the camshaft with respect to the crankshaft.

In this valve timing regulating apparatus, the torque variation received by the camshaft when the intake valve or the exhaust valve opens or closes is transmitted to the driven rotary member. Thus, the driven rotary member receives a torque variation to regard or advance side with respect to the driving rotary member. Once the driven rotary member receives this torque variation, the working fluid in the retard chambers or the advance chambers receives the force to be discharged from the retard chambers or the advance chambers, respectively. This poses the problem that, in the case where the phase of the camshaft is changed from retard to advance side as, for example, indicated by the dotted line in FIG. 16, the driven rotary member is returned to retard side by the torque variation, thereby lengthening the response time before a target phase is reached.

To cope with this problem, a method has been conceived, as disclosed in Japanese Unexamined Patent Publication No. 2003-1061115 (hereinafter referred to as patent Document 1), in which a check valve is arranged in a supply path for supplying the working fluid to each retard chamber and each advance chamber thereby to prevent the working fluid from being discharged from the retard chambers or the advance chambers even in the case where the driven rotary member receives a torque variation. It is known to prevent the driven rotary member from returning in the direction opposite to a target phase with respect to the driving rotary member while the phase is being controlled, as shown in FIG. 16 and thus to improve the phase control response.

The provision of the check valve in the supply path, however, requires a discharge path separate from the supply path for discharging the work fluid from the retard chambers and the advance chambers. In the method disclosed in patent Document 1, the operation of switching the supply path and the discharge path is carried out with a single switching valve and, therefore, the number of the paths connected to the switching valve is increased, thereby leading to the problem of a bulky switching valve.

SUMMARY OF THE INVENTION

This invention has been achieved to solve this problem, and the object thereof is to provide a valve timing regulating apparatus comprising a compact switching valve for switching the supply path and the discharge path with a fast phase-control response.

According to first to eleventh aspects of the present invention, there is provided a valve timing regulating apparatus wherein a check valve is arranged in a supply path to allow working fluid to flow from a fluid source to retard chambers and advance chambers and to prohibit the working fluid from flowing from the retard chambers and the advance chambers to the fluid source, so that even in the case where a driven rotary member receives a torque variation from a driven shaft when the driven rotary member is rotated relatively with respect to the driving rotary member to a target phase, the working fluid is prevented from flowing out of the retard chambers or the advance chambers supplied with the working fluid. As a result, the driven rotary member is prevented from returning to the side opposite to the target phase and, therefore, the driven rotary member reaches the target phase quickly with respect to the driving rotary member. This improves the phase-control response.

Further, a supply switching valve for controlling the switching operation of the supply path and a discharge switching valve for controlling the switching operation of the discharge path are configured as separate entities and, therefore, both the supply switching valve and the discharge switching valve can be reduced in size.

According to a third aspect of the invention, there is provided a valve timing regulating apparatus, wherein the check valve is arranged on a first vane rotor, and the length of the path from each retard chamber and each advance chamber to the check valve is shortened, thereby reducing the dead volume formed by the supply path between the retard chamber/the advance chamber and the check valve. Even in the case where the driven rotary member is subjected to torque variations during the phase control, therefore, the retard chambers or the advance chambers supplied with the working fluid can be prevented from dropping in pressure. Thus, the phase-control response is improved.

According to fourth to eighth aspects of the invention, there is provided a valve timing regulating apparatus, wherein a discharge switching valve is a mechanical valve of which the switching operation is controlled by the pressure of the working fluid. Thus, the size of the discharge switching valve can be minimized.

According to fifth or sixth aspect of the invention, there is provided a valve timing regulating apparatus, wherein the discharge switching valve is a spool valve arranged on the first vane rotor or the first housing. The path length from each retard chamber and each advance chamber to the discharge switching valve is shortened and, therefore, the working fluid quickly flows out of the retard chambers and the advance chambers. In the case where the phase is controlled by discharging the working fluid from one of the retard chambers or the advance chambers and by supplying the working fluid to the other of the advance chambers or the retard chambers, the working fluid can be supplied quickly to one of the advance chambers or the retard chambers, respectively, by quickly discharging the working fluid from the other of the retard chambers or the advance chambers. As a result, the phase-control response is improved.

In the case where the target phase is reached by the driven rotary member and the driven rotary member is held at the target phase, the spool of the spool valve constituting the discharge switching valve is held at the intermediate position so that the discharge path is closed thereby to prevent the working fluid from flowing out from the retard chambers or the advance chambers to the discharge side. Nevertheless, due to the machining error of the spool, the error of the urging force of a spring for urging the spool, or the like, the spool may move to a retard or an advance side from the intermediate position thereof so that the retard discharge path for discharging the working fluid from each retard chamber or the advance discharge path for discharging the working fluid from each advance chamber may come to communicate with the discharge side. Then, the working fluid would flow out of only the retard chambers or only the advance chambers, thereby making it impossible to hold the driven rotary member at the target phase.

According to a seventh aspect of the invention, there is provided a valve timing regulating apparatus, wherein when the spool of the discharge switching valve is located at the intermediate position, the working fluid in the discharge paths communicating with the retard chambers and the advance chambers leaks from the discharge switching valve to the discharge side. As a result, even in the case where the spool moves slightly from the intermediate position due to the machining error of the spool, the error in the urging force of the springs for urging the spool, or the like, the effects of the errors can be compensated for by the fact that the working fluid flows out to the discharge side from both the retard chambers and the advance chambers. Thus, the robustness in holding the phase is improved and the driven rotary member can be easily held at the target phase.

According to a ninth aspect of the invention, there is provided a valve timing regulating apparatus, wherein the switching operation of the discharge switching valve is controlled by the pressure of the working fluid in the supply path and, therefore, the existing supply paths can be used while at the same time reducing the size of the discharge switching valve.

According to a tenth aspect of the invention, there is provided a valve timing regulating apparatus, wherein the switching operation of the discharge switching valve is controlled by the pressure of the working fluid in the supply path between the supply switching valve and the check valve. In other words, the switching operation of the discharge switching valve is controlled by the pressure of the working fluid upstream of the check valve in the supply path. Once the driven rotary member receives the torque variations from the driven shaft and the resultant pressure change of the working fluid in the retard chambers or the advance chambers increases, and the working fluid pressure in the retard chambers or the advance chambers is increased to a level higher than the pressure of the fluid source, the check valve closes the supply path and, therefore, the pressure variation in the retard chambers and the advance chambers fails to be transmitted upstream of the check valve. Even in the case where the driven rotary member receives the torque variations, therefore, the working fluid pressure for controlling the switching operation of the discharge switching valve is prevented from changing.

According to an 11th aspect of the invention, there is provided a valve timing regulating apparatus, wherein the check valve is arranged downstream of the bearing of the driving shaft in the supply path. Once the driven rotary member receives the variation torque, therefore, the check valve closes the supply path downstream of the bearing. Even in the case where the driven rotary member receives the variation torque and the pressure of the working fluid in the retard chambers and the advance chambers undergoes a change, the pressure change is not transmitted to the sliding portion between the bearing and the driven shaft located upstream of the check valve. Even though the driven rotary member receives the variation torque, therefore, the working fluid in the retard chambers and the advance chambers is prevented from leaking from the sliding portion between the driven shaft and the bearing and, therefore, the phase-control response is improved.

The present invention may be more fully understood from the description of the preferred embodiments of the invention set forth below, together with the accompanying drawings.

DESCRIPTION OF THE PREFERRED EMBODIMENTS

A plurality of embodiments of the invention are explained below with reference to the drawings.

First Embodiment

Figure 1:
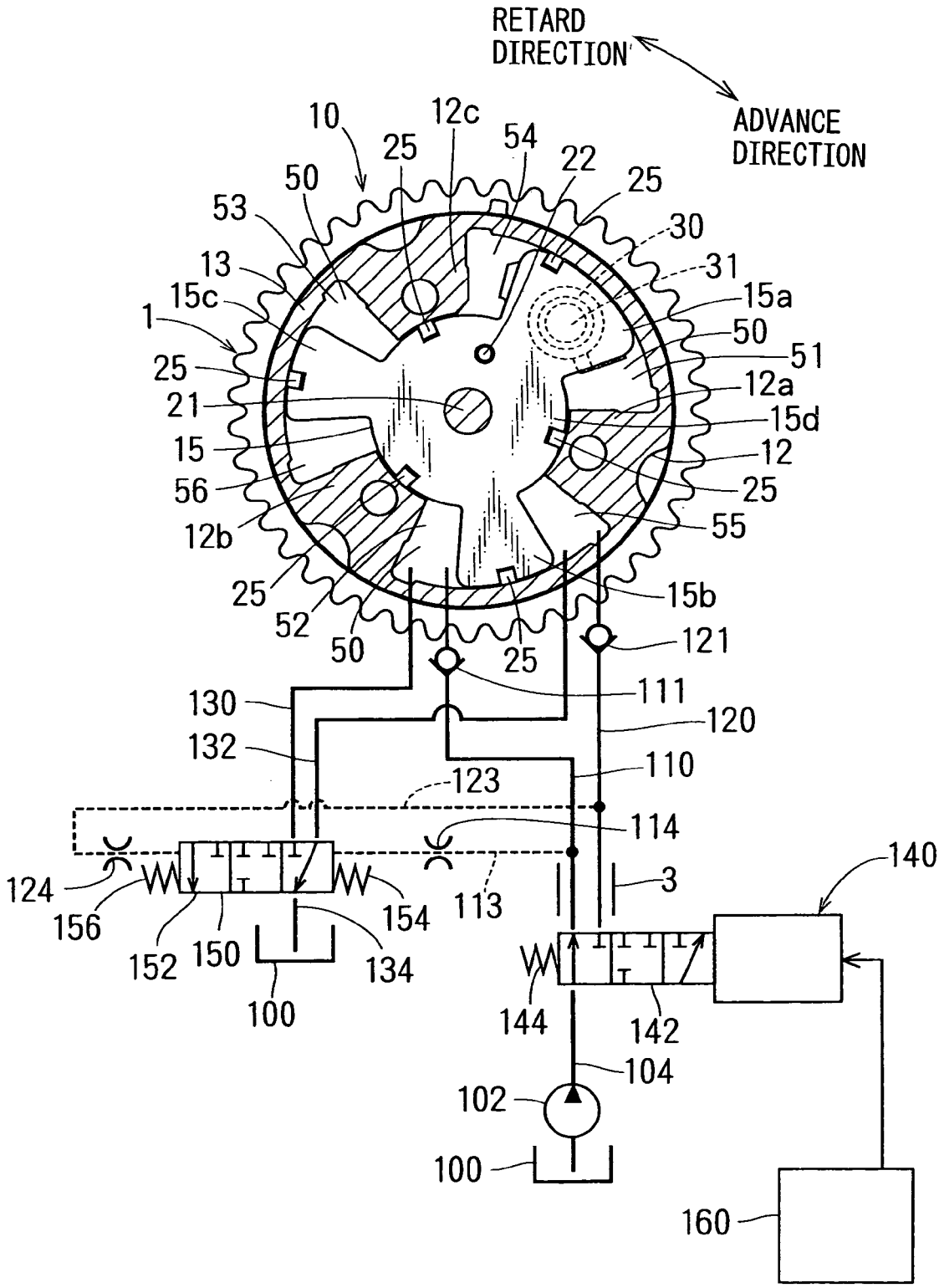
FIG. 1 is a sectional view taken along line I—I in FIG. 2.
Figure 2:
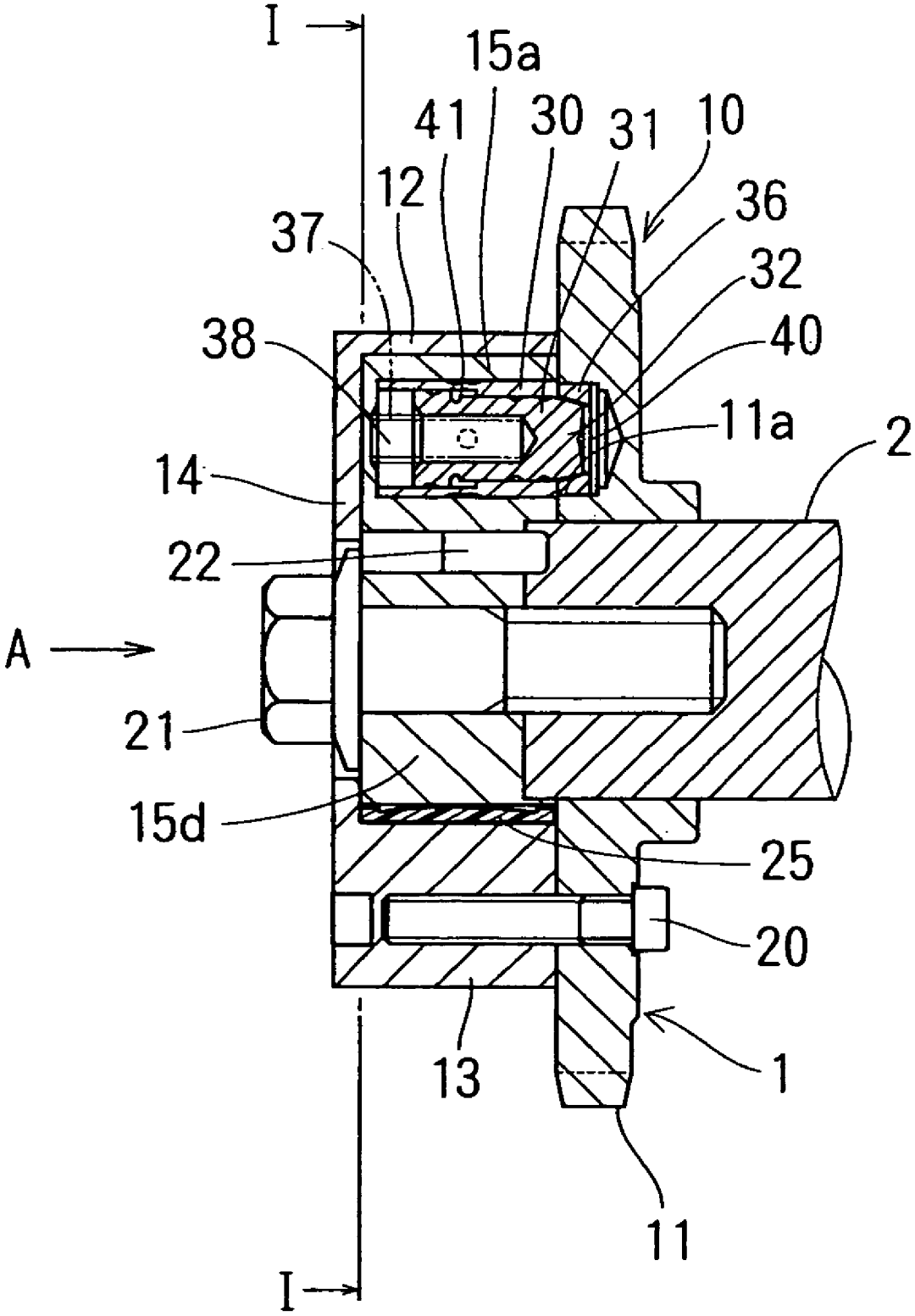
FIG. 2 is a longitudinal sectional view showing a valve timing regulating apparatus according to a first embodiment of the invention.

A valve timing regulating apparatus according to a first embodiment of the invention is shown in FIGS. 1 and 2. FIG. 2 is a longitudinal sectional view based on the cross sectional view of FIG. 1 cut away through a stopper piston 31, a pin 22, a bolt 21, seal members 25 and a bolt 20. The valve timing regulating apparatus 1 according to this embodiment is hydraulically controlled using a working oil as a working fluid and is intended to regulate the valve timing of an intake valve.

As shown in FIG. 2, a housing 10 making up a first housing and doubling as a driving rotary member has a chain sprocket 11 and a shoe housing 12. The shoe housing 12 includes, integrated with each other, partitioning shoes 12*a*, 12*b*, 12*c*, an annular peripheral wall 13 and a front plate 14 located on the opposite side of the chain sprocket 11 and sandwiches the peripheral wall 13 together with the chain sprocket 11. The chain sprocket 11 and the shoe housing 12 are fixed on the same axis by the bolts 20. The chain sprocket 11 is coupled to the crankshaft as a drive shaft of the internal combustion engine (hereinafter referred to as "the engine") not shown by a chain not shown. In this way, the driving force is transmitted to the chain sprocket 11, which rotates in synchronism with the crankshaft.

The driving force of the crankshaft is transmitted to the camshaft 2 making up a driven shaft through the valve timing regulating apparatus 1 to thereby operate the intake valve, not shown. The camshaft 2 is adapted to rotate with a predetermined phase difference with respect to the chain sprocket 11. The housing 10 and the camshaft 2 rotate clockwise as viewed from the direction of arrow A shown in FIG. 2. This direction of the rotation is hereinafter referred to as the advance direction.

As shown in FIG. 1, the trapezoidal shoes 12*a*, 12*b*, 12*c* extend from the peripheral wall 13 diametrically inward and are arranged substantially equidistantly along the direction of rotation of the peripheral wall 13. Fan-shaped first accommodation chambers 50 for accommodating the vanes 15*a*, 15*b*, 15*c* respectively are formed in the three spaces formed by the shoes 12*a*, 12*b*, 12*c* along the direction of rotation.

The vane rotor 15 making up a first vane rotor includes a boss 15*d* and vanes 15*a*, 15*b*, 15*c* constituting the first vanes arranged substantially equidistantly along the direction of rotation on the outer peripheral side of the boss 15*d*. The vane rotor 15 is accommodated in the housing 10 and is relatively rotatable with respect thereto. The vanes 15*a*, 15*b*, 15*c* are accommodated rotatably in the respective accomodation chambers 50. Each vane partitions the corresponding accommodation chamber 50 into a retard oil pressure chamber and an advance oil pressure chamber. The arrows indicating the retard and advance directions in FIG. 1 represent the retard and advance directions, respectively, of the vane rotor 15 with respect to the housing 10. The vane rotor 15 making up a driven rotary member comes into contact with the end surface of the camshaft 2 in the direction of the rotary axis of the camshaft 2 and is integrally fixed on the camshaft 2 by the bolt 21. The vane rotor 15 is set in position in rotational direction with respect to the camshaft 2 by the pin 22 shown in FIG. 2.

As shown in FIG. 1, the seal members 25 are arranged each between each shoe and the boss 15*d* facing each other radially and in a sliding gap formed between each vane and the inner peripheral wall of the peripheral wall 13. Each of the seal members 25 is fitted in grooves formed in the outer peripheral walls of respective vanes and in grooves of the boss 15*d* and urged toward the inner peripheral wall of the peripheral wall 13 and each shoe by a spring or the like. In this configuration the seal members 25 prevent the working oil from leaking between each retard oil pressure chamber and a corresponding advance oil pressure chamber.

As shown in FIG. 2, a cylindrical guide ring 30 is fitted under pressure into the vane 15*a*. A cylindrical stopper piston 31 is accommodated in the guide ring 30 slidably in the direction along the rotary axis. A fitting ring 36 is held under pressure in a recess 11*a* formed in the chain sprocket 11. The stopper piston 31 is adapted to be fitted in contact with the fitting ring 36. The sides of the stopper piston 31 and the fitting ring 36 in contact with each other are tapered. Therefore, the stopper piston 31 is fitted smoothly in the fitting ring 36. The spring 37 making up an urging means urges the stopper piston 31 toward the fitting ring 36. The stopper piston 31, the fitting ring 36 and the spring 37 make up a means for restricting the relative rotation of the vane rotor 15 relative to the housing 10.

The pressure of the working oil supplied to oil pressure chambers 40, 41 acts in such a direction that the stopper piston 31 comes off from the fitting ring 36. The oil pressure chamber 40 communicates with any one of the advance oil pressure chambers described later, and the oil pressure chamber 41 communicates with a retard oil pressure chamber 51 (FIG. 1). The forward end portion of the stopper piston 31 is adapted to be fitted in the fitting ring 36 when the vane rotor 15 is located at the largest retard position with respect to the housing 10. With the stopper piston 31 fitted in the fitting ring 36, the rotation of the vane rotor 15 relative to the housing 10 is restricted.

With the rotation of the vane rotor 15 from the largest retard position to the advance side with respect to the housing 10, the stopper piston 31 and the fitting ring 36 are displaced from each other in rotational positions, and therefore the stopper piston 31 can no longer be fitted in the fitting ring 36.

As shown in FIG. 1, the retard oil pressure chamber 51 is formed between the shoe 12*a* and the vane 15*a*, a retard oil pressure chamber 52 is formed between the shoe 12*b* and the vane 15*b*, and a retard oil pressure chamber 53 is formed between the shoe 12*c* and the vane 15*c*. Also, an advance oil pressure chamber 54 is formed between the shoe 12*c* and the vane 15*a*, an advance oil pressure chamber 55 between the shoe 12*a* and the vane 15*b*, and an advance oil pressure chamber 56 between the shoe 12*b* and the vane 15*c*.

The working oil pumped from a drain 100 is supplied to a supply path 104 by an oil pump 102 making up a fluid source. A supply switching valve 140 is a well-known electromagnetic spool valve and is arranged between the supply path 104 on the one hand and the retard supply path 110 and the advance supply path 120 on the other hand. The switching operation of the supply switching valve 140 is controlled by the drive current with the duty factor thereof controlled and supplied from an engine control unit (ECU) 160. A spool 142 of the supply switching valve 140 is displaced in accordance with the duty factor of the drive current. In accordance with the position of the spool 142, the supply switching valve 140 can selectively switch the communication between the supply path 104 and the retard supply path 110 and the communication between the supply path 104 and the advance supply path 120. With the power cut off to the supply switching valve 140, the spool 142 is located at the position shown in FIG. 1 by the urging force of a spring 144.

The retard supply path 110 and the advance supply path 120 supply the working oil to each retard oil pressure chamber and each advance oil pressure chamber, respectively, from a bearing 3 of the camshaft 2 through the camshaft 2. The retard supply path 110 communicates with each retard oil pressure chamber, and the advance supply path 120 with each advance oil pressure chamber. Check valves 111, 121 are arranged, respectively, in the retard supply path 110 and the advance supply path 120. The check valve 111 allows the working oil to be supplied from the oil pump 102 to each retard oil pressure chamber and prohibits the reverse flow of the working oil from each retard oil pressure chamber to the oil pump 102 side. The check valve 121, on the other hand, allows the working oil to be supplied from the oil pump 102 to each advance oil pressure chamber and prohibits the reverse flow of the working oil from each advance oil pressure chamber to the oil pump 102 side. The retard supply path 110 and the advance supply path 120 branch into the retard oil pressure chambers and the advance oil pressure chambers, respectively, downstream of the check valves 111, 121. Thus, the retard oil pressure chambers communicate with each other, and so do the advance oil pressure chambers, downstream of the check valves 111, 121, respectively.

A retard discharge path 130 communicates with the retard oil pressure chamber 52, and an advance discharge path 132 communicates with the advance oil pressure chamber 55. A discharge switching valve 150 making up a mechanical spool valve is configured as an entity independent of the supply switching valve 140, and is arranged between the retard discharge path 130/the advance discharge path 132 and a discharge path 134. The discharge path 134 is open to the drain 100. A spool 152 of the discharge switching valve 150 is urged in opposite directions by springs 154, 156. A retard control path 113 communicating with the retard supply path 110 and an advance control path 123 communicating with the advance supply path 120 exert the working oil pressure in opposite directions on the ends of the spool 152 through the orifices 114, 124, respectively. As the oil pressure is exerted on the spool 152 through the orifices 114, 124, the variation in the discharge pressure of the oil pump 102 transmitted to the discharge switching valve 150 can be reduced.

With the oil path configuration described above, the working oil can be supplied from the oil pump 102 to the retard oil pressure chambers 51, 52, 53, the advance oil pressure chambers 54, 55, 56 and the oil pressure chambers 40, 41, while at the same time making it possible to discharge the working oil from each oil pressure chamber to the drain 100.

Next, the operation of the valve timing regulating apparatus 1 is explained.

With the engine stopped, the stopper piston 31 is fitted in the fitting ring 36. Immediately after the engine starts, the working oil is not sufficiently supplied from the oil pump 102 to the retard oil pressure chambers 51, 52, 53, the advance oil pressure chambers 54, 55, 56 and the oil pressure chambers 40, 41. Therefore, the stopper piston 31 remains fitted in the fitting ring 36, and the camshaft 2 is held at the most retarded position with respect to the crankshaft. As a result, the housing 10 and the vane rotor 15 are prevented from bumping against each other by the torque variation received by the camshaft 2 before the working oil is supplied to each oil pressure chamber.

Once the working oil is sufficiently supplied from the oil pump 102 after the engine is started, the stopper piston 31 comes off from the fitting ring 36 under the pressure of the working oil supplied to the oil pressure chamber 40 or 41 and, therefore, the vane rotor 15 can be freely rotated relatively to the housing 10. By controlling the oil pressure exerted on each retard oil pressure chamber and each advance oil pressure chamber, the phase difference of the camshaft 2 with respect to the crankshaft is regulated.

With power cut off to the supply switching valve 140 as shown in FIG. 1, the spool 142 is located at the position shown in FIG. 1 due to the urging force of the spring 144. Under this condition, the working oil is supplied from the supply path 104 to the retard supply path 110 and, through the check valve 111, to each retard oil pressure chamber. The working oil is also supplied from the retard supply path 110 to the retard control path 113, while no working oil is supplied from the advance supply path 120 to the advance control path 123. Thus, the spool 152 of the discharge switching valve 15 is located at the position shown in FIG. 1. Under this condition, the working oil is discharged from the advance oil pressure chamber 55 to the drain 100 through the advance discharge path 132, the discharge switching valve 150 and the discharge path 134. The working oil in the advance oil pressure chambers 54, 56 is discharged through the advance oil pressure chamber 55. In this way, the working oil is supplied to each retard oil pressure chamber, and is discharged from each advance oil pressure chamber, thereby rotating the vane rotor 15 in the retard direction with respect to the housing 10.

In the case where the phase is controlled to the target phase on the retard side by supplying the working oil to each retard oil pressure chamber and discharging it from each advance oil pressure chamber as shown in FIG. 1, the torque variation received by the camshaft 2 subjects the vane rotor 15 to a torque variation to retard or advance side with respect to the housing 10. Once the vane rotor 15 is subjected to a torque variation to advance side, the working oil in each retard oil pressure chamber receives the force which pushes the working oil out toward the retard supply path 110. As the check valve 111 is arranged in the retard supply path 110, however, no working oil flows out to the retard supply path 110 from each retard oil pressure chamber. As a result, the vane rotor 15, in spite of receiving the torque variation from the camshaft 2, is prevented from returning to the advance side opposite to the target phase with respect to the casing and, therefore, the target phase can be quickly achieved.

Figure 3:
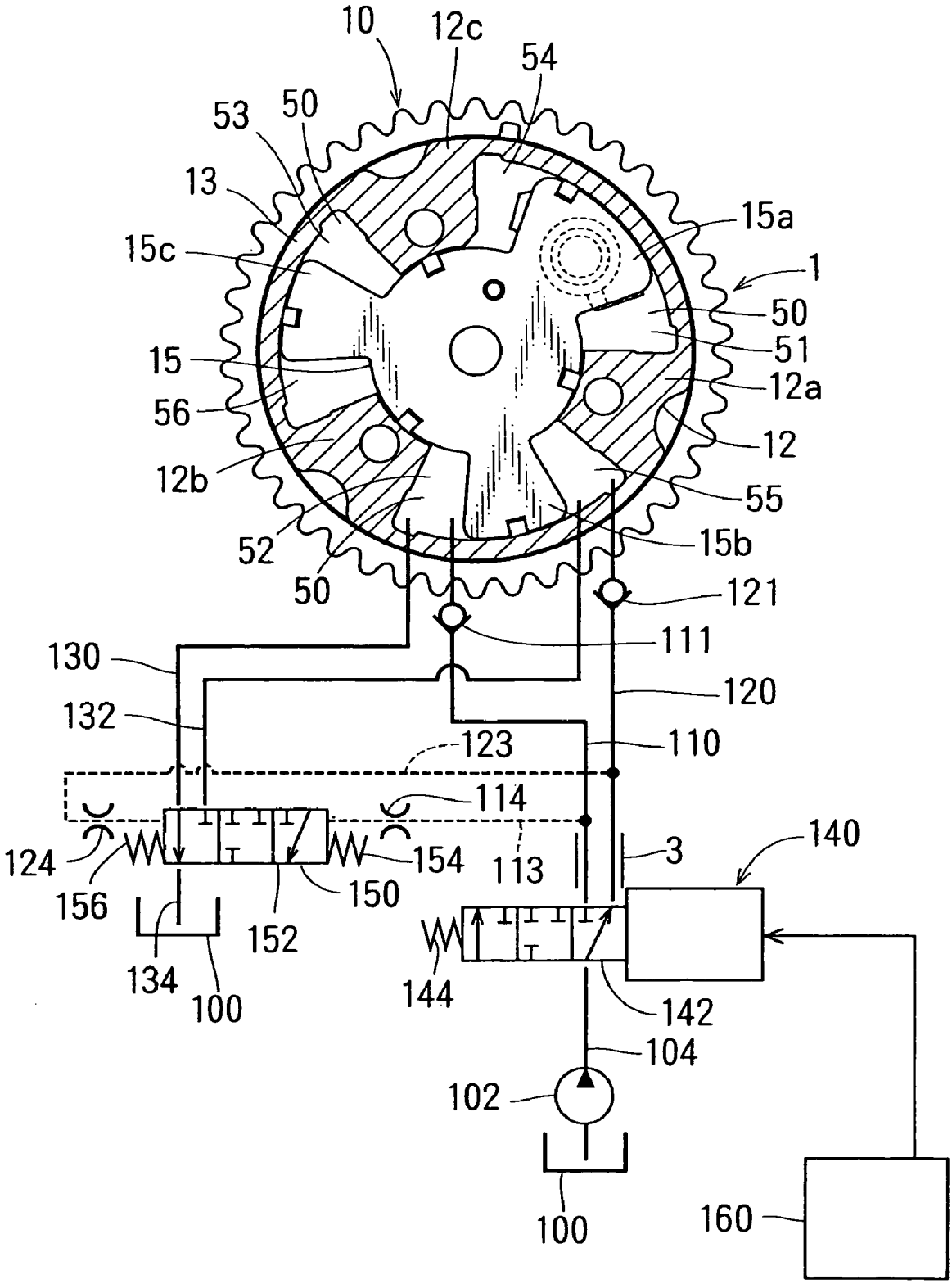
FIG. 3 is a sectional view showing the state of the valve timing regulating apparatus at the time of phase retard control.

With electric power supplied to the supply switching valve 140, on the other hand, the spool 142 is located at the position shown in FIG. 3 due to the electromagnetic force applied against the urging force of the spring 144, as shown in FIG. 3. Under this condition, the working oil is supplied from the supply path 104 to the advance supply path 120 and, through the check valve 121, to each advance oil pressure chamber. The working oil is then supplied from the advance supply path 120 to the advance control path 123, while no working oil is supplied from the retard supply path 110 to the retard control path 113. Therefore, the spool 152 of the discharge switching valve 150 is located at the position shown in FIG. 3. Under this condition, the working oil in the retard oil pressure chamber 52 is discharged to the drain 100 through the retard discharge path 130, the discharge switching valve 150 and the discharge path 134. The working oil in the retard oil pressure chambers 51, 53 is discharged through the retard oil pressure chamber 52. In this way, the working oil is supplied to each advance oil pressure chamber, and is discharged from each retard oil pressure chamber. Thus, the vane rotor 15 is rotated to the advance side with respect to the housing 10.

Figure 16:
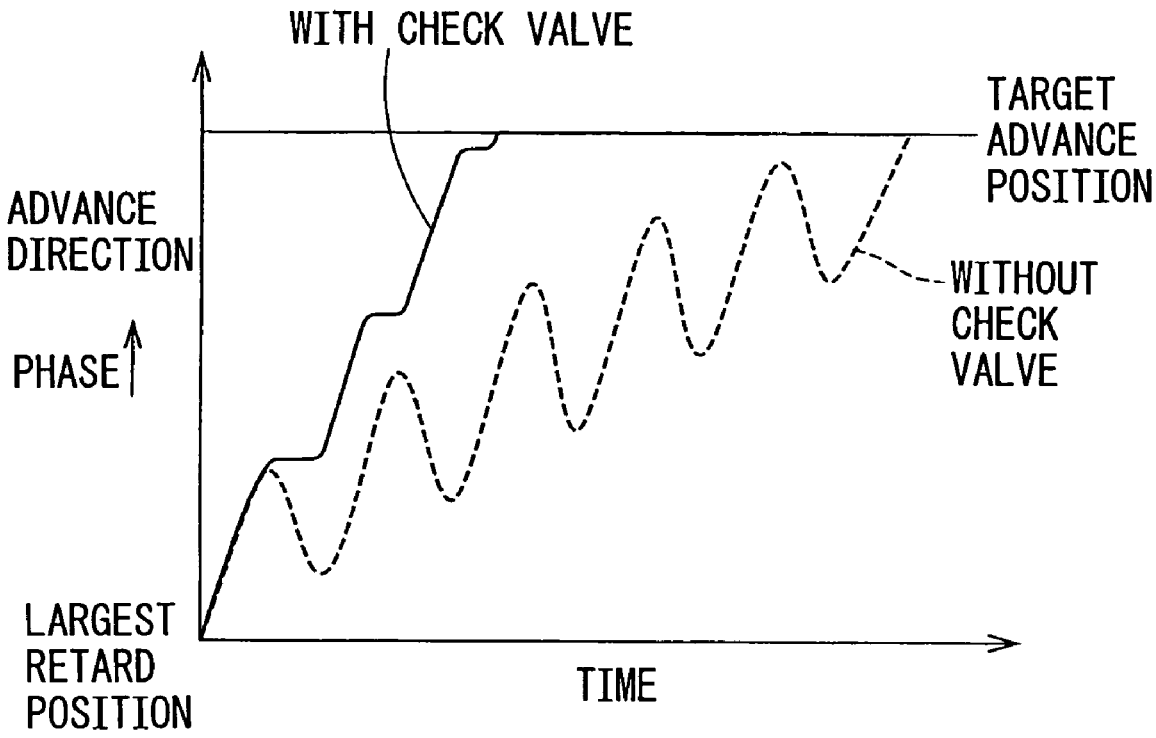
FIG. 16 is a characteristic diagram showing the difference in the time before arrival at the target phase due to the presence or absence of the check valve.

In the case where the phase is controlled to the advance-side target phase by supplying the working oil to each advance oil pressure chamber and discharging it from each retard oil pressure chamber, as shown in FIG. 3, the vane rotor 15 is subjected to the torque variation in both the retard and the advance directions with respect to the housing 10 as in the retard control. Once the vane rotor 15 is subjected to the torque variation to the retard side, the working oil in each advance oil pressure chamber is subjected to the force which pushes the working oil out toward the advance supply path 120. In view of the fact that the check valve 121 is arranged in the advance supply path 120, however, no working oil flows out from each advance oil pressure chamber to the advance supply path 120. As a result, even in the case where the vane rotor 15 receives the torque variation from the camshaft 2, as shown in FIG. 16, the vane rotor 15 is prevented from returning to the retard side opposite to the target phase with respect to the housing 10. Therefore, the target phase can be quickly achieved.

Figure 4:
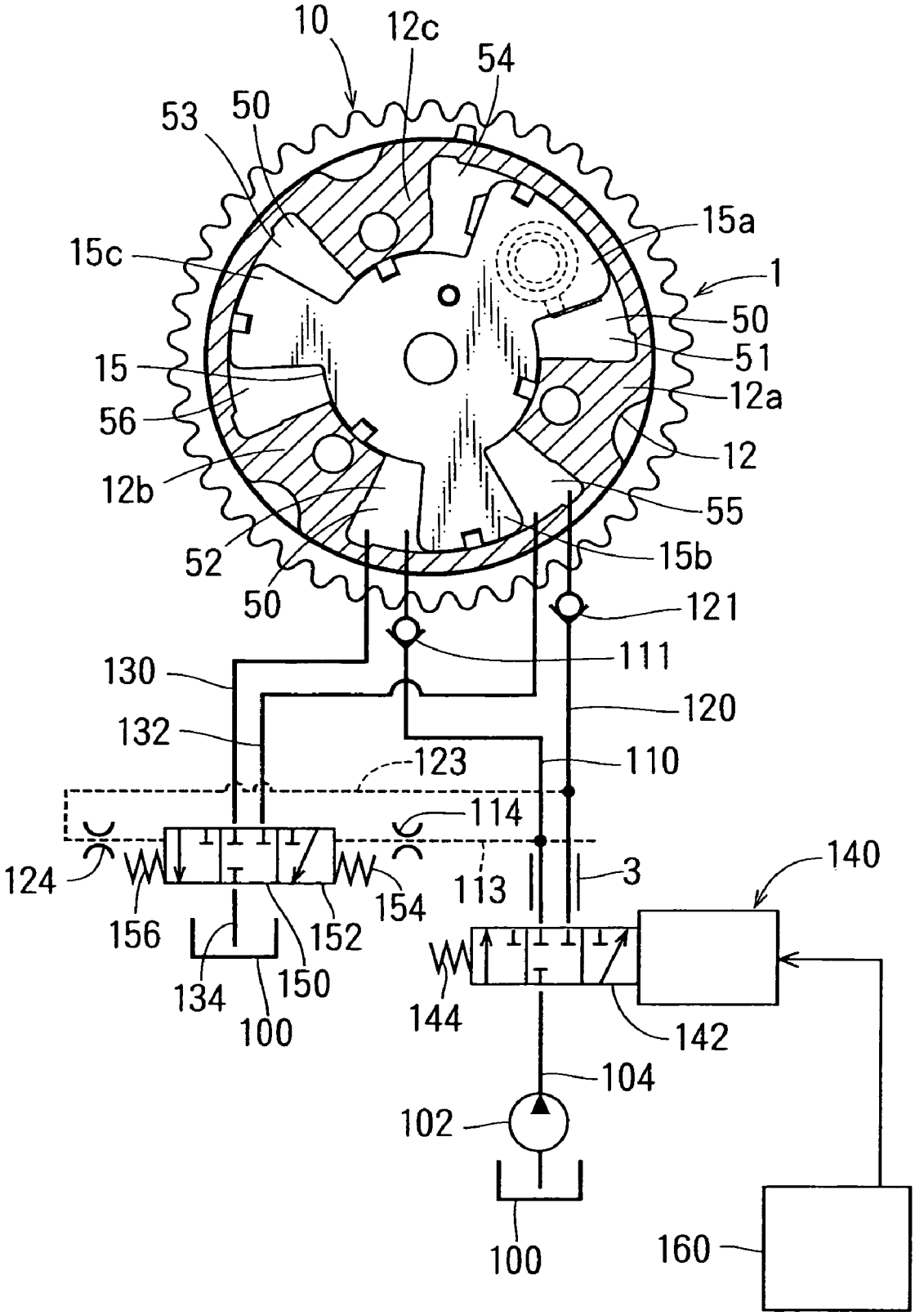
FIG. 4 is a sectional view showing the state of the valve timing regulating apparatus in the state of holding the phase.

Once the vane rotor 15 reaches the target phase, the ECU 160 controls the duty factor of the drive current supplied to the supply switching valve 140, and holds the spool 142 at the position shown in FIG. 4. Under the condition shown in FIG. 4, the supply of the working oil from the oil pump 102 to the retard supply path 110 and the advance supply path 120 is blocked. Also, no working oil is supplied to the retard control path 113 and the advance control path 123 and, therefore, the spool 152 of the discharge switching valve 150 is located at the position shown in FIG. 4. Thus, the communication is cut off between the retard discharge path 130/the advance discharge path 132 and the discharge path 134. Under the condition shown in FIG. 4, the check valves 111, 112 prevent the working oil from flowing out from each retard oil pressure chamber and each advance oil pressure chamber to the retard supply path 110 and the advance supply path 120. Also, the discharge switching valve 150 prevents the working oil from being discharged from each retard oil pressure chamber and each advance oil pressure chamber through the retard discharge path 130 and the advance discharge path 132 to the drain 100. Thus, the vane rotor 15 is held at the target phase.

Second Embodiment

Figure 5:
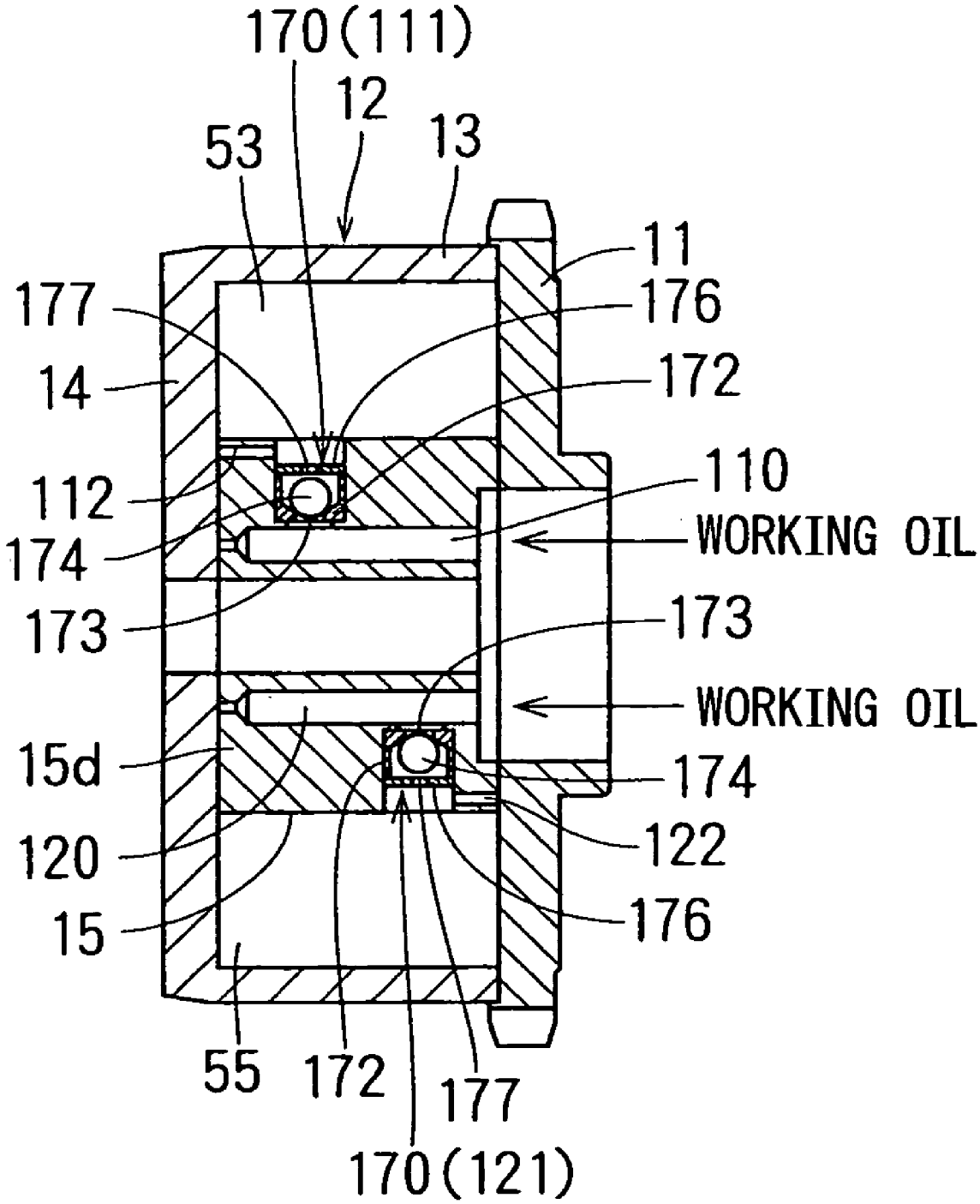
FIG. 5 is a sectional view showing an example of a check valve in the valve timing regulating apparatus according to a second embodiment of the present invention.

A second embodiment of the present invention is shown in FIG. 5. In FIG. 5, the component parts substantially identical or similar to those in the first embodiment are designated by the same reference numerals.

A check valves 170 shown in FIG. 5 represent a specific configuration of the check valves 111, 121 explained in the first embodiment. According to the second embodiment, the check valves 111, 121 have substantially the same configuration. The check valve 170, on the other hand, is arranged in a recess formed in a boss 15*d* of a vane rotor 15 and prevents the working oil from flowing in the reverse direction from a retard oil pressure chamber 53 and an advance oil pressure chamber 55 toward an oil pump 102. The retard oil pressure chamber 53 and the other retard oil pressure chambers 51, 52 communicate with each other through a communication path 112 downstream of the check valve 170. The advance oil pressure chamber 55 and the other advance oil pressure chambers 54, 56, on the other hand, communicate with each other through a communication path 122 downstream of the check valve 170. The check valve 170 thus prevents the working oil from flowing in the reverse direction from each retard oil pressure chamber and each advance oil pressure chamber toward the oil pump 102. The communication path 112 constitutes a part of the retard supply path 110, and the communication path 122 constitutes a part of the advance supply path 120.

The check valves 170 each include a valve body 172 having an upstream communication hole 173, a ball 174 seated on the inner wall of the valve body 172 and adapted to close the upstream communication hole 173, and a tabular seal member 176 covering the portion of the ball 174 far from the upstream communication hole 173 and having a downstream communication hole 177. The side of the first check valve 170 downstream of the downstream communication hole 177 communicates with the retard oil pressure chamber 53 on the one hand and communicates with the communication path 112 extending toward a front plate 14 in the boss 15*d* on the other hand. The communication path 112 is further formed in an arcuate form on the end surface of the boss 15*d* near to the front plate 14 and communicates with the other retard oil pressure chambers 51, 52. The side of the second check valve 170 downstream of the downstream communication hole 177, on the other hand, communicates with the advance oil pressure chamber 55 on the one hand and with the communication path 122 extending toward the chain sprocket 11 in the boss 15*d* on the other hand. The communication path 122 is further formed in an arcuate form on the end surface of the boss 15*d* near to the chain sprocket 11 and communicates with the other advance oil pressure chambers 54, 56. The ball 174 is seated on the inner wall around the upstream communication hole 173 of the valve body 172 and thus prevents the working oil from flowing in reverse direction from each retard oil pressure chamber and each advance oil pressure chamber toward the oil pump 102.

According to the second embodiment, the check valves 170 are arranged on the vane rotor 15 and, therefore, the path between each retard oil pressure chamber or each advance oil pressure chamber and each check valve 170 is shortened. As a result, the dead volume formed by the supply paths 110, 120 between each retard oil pressure chamber or each advance oil pressure chamber and each check valve 170 is reduced. Even in the case where the vane rotor 15 is subjected to a torque variation at the time of phase control, therefore, the pressure of each retard oil pressure chamber or each advance oil pressure chamber supplied with the working oil can be prevented from decreasing. Thus, the phase control response is improved.

Third Embodiment

Figure 7:
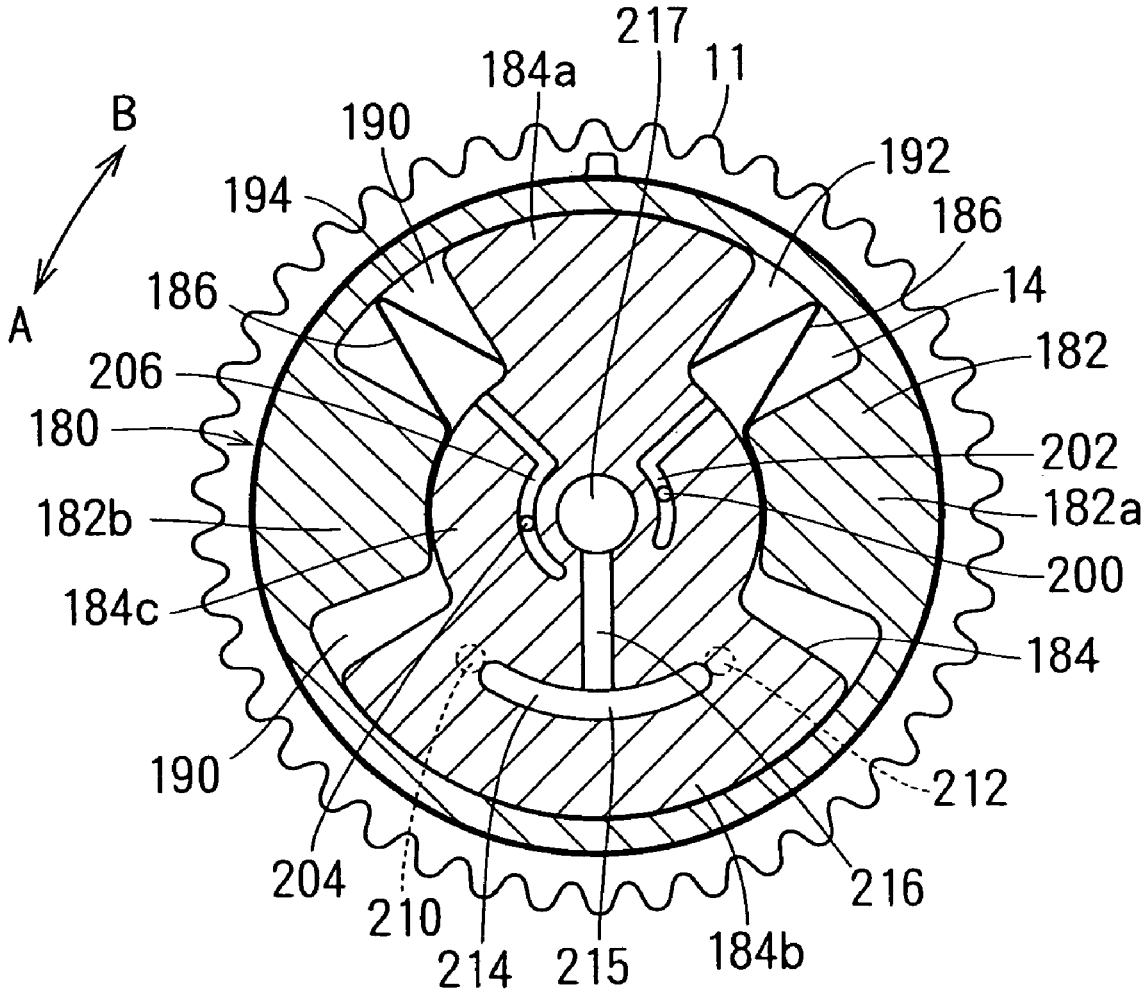
FIG. 7 is a sectional view taken along line VII—VII in FIG. 6.
Figure 8:
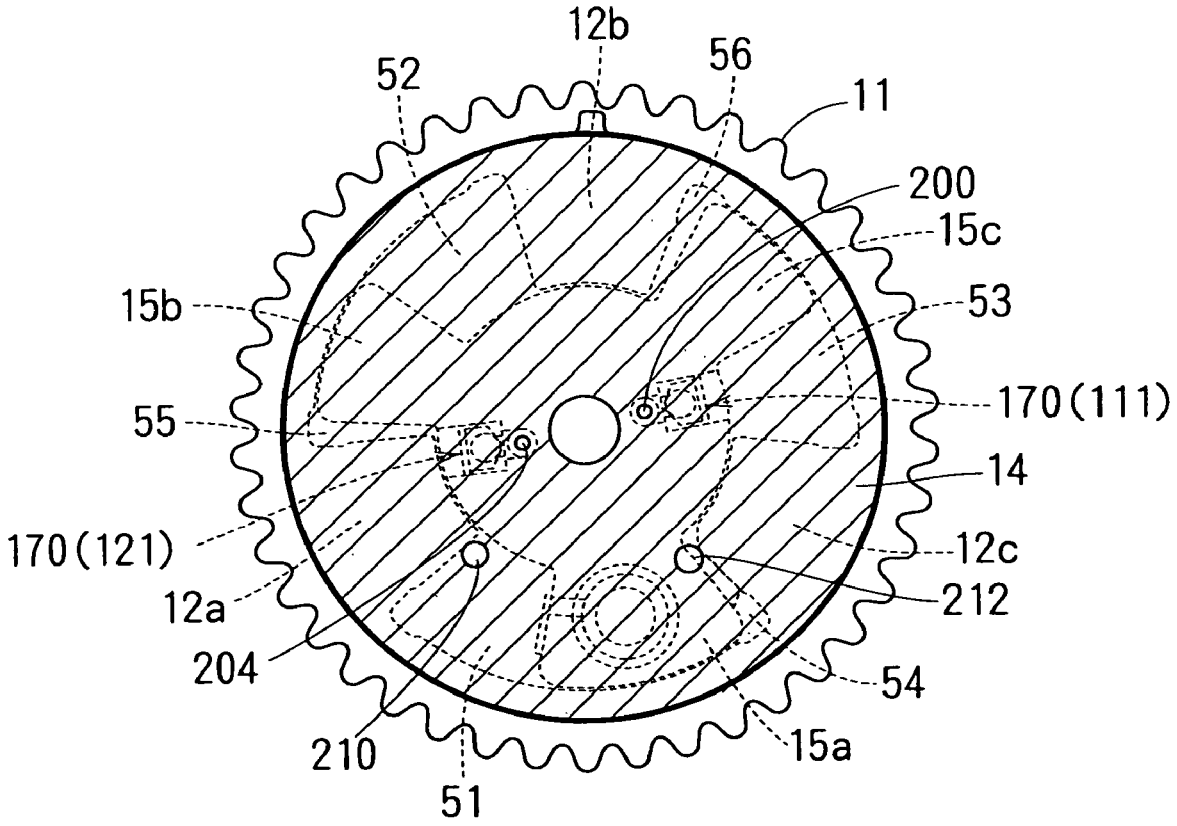
FIG. 8 is a sectional view taken along line VIII—VIII in FIG. 6.
Figure 9:
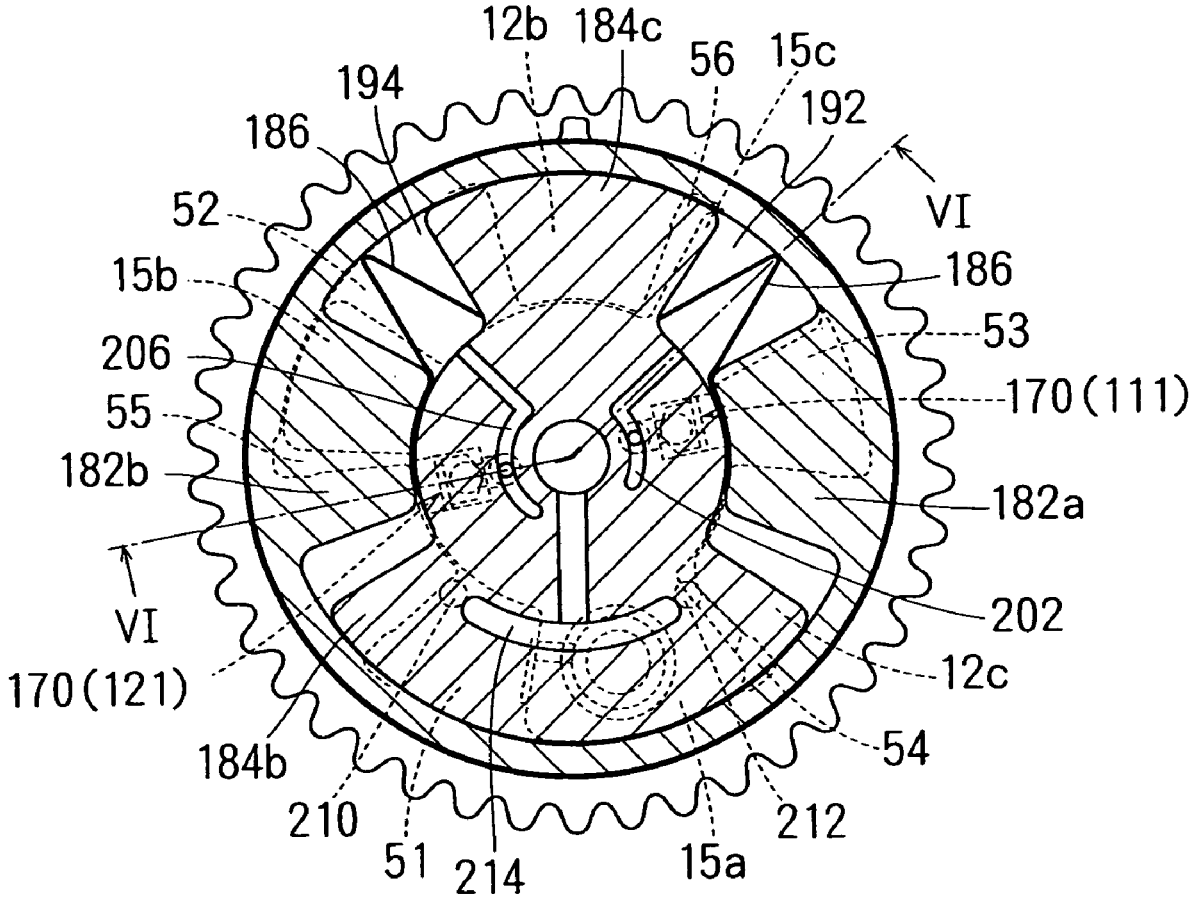
FIG. 9 is a diagram for explaining the superposed state of FIGS. 7 and 8.

A third embodiment of the invention is shown in FIGS. 6 to 9. FIG. 9 is a superposition of FIGS. 7 and 8. In FIGS. 6 to 9, those component parts substantially identical or similar to the corresponding component parts in the first and second embodiments are designated by the same reference numerals, respectively.

Figure 6:
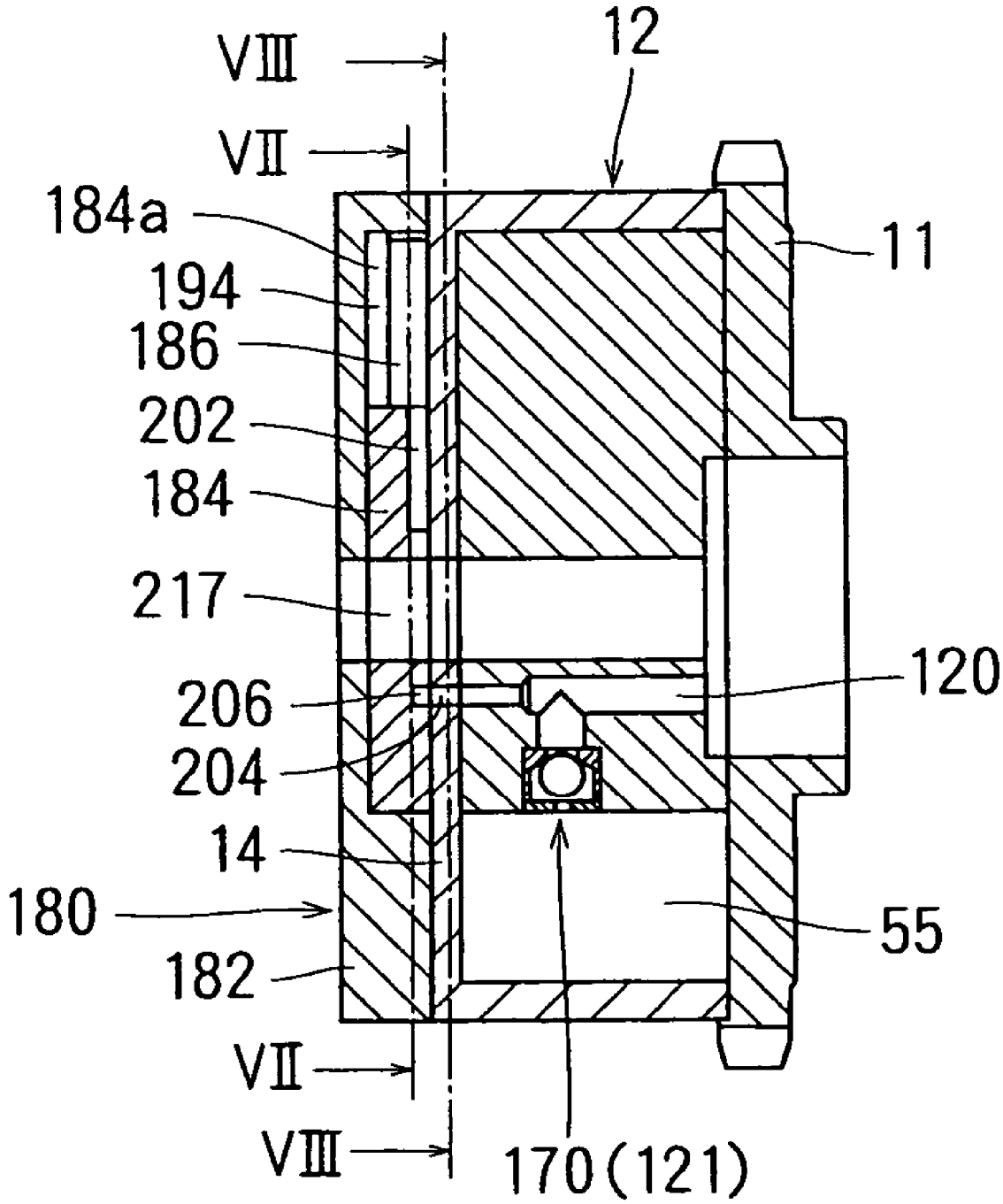
FIG. 6 is a sectional view taken along line VI—VI in FIG. 9 showing a valve timing regulating apparatus according to a third embodiment of the present invention.

According to the third embodiment, a vane-type discharge switching valve 180 is used as the discharge switching valve 150 according to the first embodiment. As shown in FIGS. 6 and 7, the discharge switching valve 180 includes a shoe housing 182, a vane rotor 184 and spring plates 186 and is arranged on the outer wall of a front plate 14 of the shoe housing 12. The retard oil pressure chambers communicate with each other and so do the advance oil pressure chambers, downstream of the check valves 170.

The shoe housing 182 making up a second housing has the same outer diameter and is fixed on the same axis as the shoe housing 12. The shoe housing 182 is rotated integrally with the shoe housing 12. Shoes 182*a*, 182*b* are arranged on the diametrically opposite sides of the shoe housing 182 and are projected toward the center of the diameter. Two fan-shaped accommodation chambers 190 making up second accommodation chambers are formed between the shoes 182*a* and 182*b*.

A vane rotor 184 constituting a second vane rotor includes a boss 184*c*, and vanes 184*a*, 184*b* formed on the diametrically opposite sides with respect to the boss 184*c* and projecting diametrically outward from the boss 184*c*. The vane 184*a* making up a second vane divides the first accommodation chamber 190 into two chambers including a retard control chamber 192 and an advance control chamber 194. The vane rotor 184 rotates relatively with respect to the shoe housing 182 under the oil pressure exerted from the retard control chamber 192 and the advance control chamber 194.

The spring plates 186 are fixed on the inner peripheral walls of the shoes 182*a*, 182*b*, respectively, and are adapted to urge the vane 184*a* to rotate in two directions relatively with respect to the shoe housing 182.

As shown in FIGS. 6 and 8, a retard control path 200 and an advance control path 204 are formed through the front plate 14 of the shoe housing 12. As shown in FIGS. 6 and 7, a retard control path 202 and an advance control path 206 are formed on the end surface of the boss 184*c* nearer to the front plate 14. As shown in FIGS. 7 and 9, the retard control path 202 establishes communication between the retard control path 200 and the retard control chamber 192, and the advance control path 206 establishes communication between the advance control path 204 and the advance control chamber 194. As shown in FIGS. 6 and 8, a retard discharge path 210 and an advance discharge path 212 are formed through the front plate 14. The retard discharge path 210 communicates with the retard oil pressure chamber 51, and the advance discharge path 212 communicates with the advance oil pressure chamber 54. As shown in FIGS. 7 and 9, a discharge path 214 has an arcuate path 215 and a linear path 216, and is formed on the end surface of the vane 184*b* nearer to the front plate 14. The angle of the arc formed by the arcuate path 215 in the rotational direction is slightly smaller than the rotational angle formed by the retard discharge path 210 and the advance discharge path 212.

According to the third embodiment, the retard control paths 200, 202 correspond to the retard control path 113 of the first embodiment, and the advance control paths 204, 206 to the advance control path 123 of the first embodiment. Also, the retard discharge path 210 corresponds to the retard discharge path 130 according to the first embodiment, and the advance discharge path 212 corresponds to the advance discharge path 132 according to the first embodiment. Further, the discharge path 214 corresponds to the discharge path 134 according to the first embodiment.

At the time of phase retard control by supplying the working oil from the retard supply path 110 to each retard oil pressure chamber, the working oil flows from the retard supply path 110 through the retard control paths 200, 202 to the retard control chamber 192. In FIG. 7, therefore, the vane rotor 184 is rotated in the direction of arrow A with respect to the shoe housing 182. Then, the arcuate path 215 of the discharge path 214 comes to communicate with the advance discharge path 212, and the retard discharge path 210 is closed by the vane 184*b*. Therefore, the working oil in the advance oil pressure chamber 54 and in the advance oil pressure chambers 55, 56 passing through the advance oil pressure chamber 54 is discharged from the arcuate path 215 and the linear path 216 to a drain port 217.

At the time of phase advance control by supplying the working oil from the advance supply path 120 to each advance oil pressure chamber, on the other hand, the working oil flows from the advance supply path 120 through the advance control paths 204, 206 to the advance control chamber 194. In FIG. 7, therefore, the vane rotor 184 is rotated in the direction of arrow B with respect to the shoe housing 182. Then, the arcuate path 215 of the discharge path 214 communicates with the retard discharge path 210, and the advance discharge path 212 is closed by the vane 184*b*. Therefore, the working oil in the retard oil pressure chamber 51 and in the retard oil pressure chambers 52, 53 passing through the retard oil pressure chamber 51 is discharged from the arcuate path 215 and the linear path 216 to the drain port 217.

Once the target phase is reached, the working oil ceases to be supplied to the retard control path 200 and the advance control path 204 and, therefore, the vane rotor 184 is held at the intermediate position indicated in FIG. 7 by the urging force of the spring plates 186 acting on the vane 184*b* in opposite directions. In the process, the retard discharge path 210 and the advance discharge path 212 are closed by the vane 184*b* and fail to communicate with the arcuate path 215. Therefore, the working oil is not discharged to the drain 100 from each retard oil pressure chamber and each advance oil pressure chamber.

According to the third embodiment, the vane-type discharge switching valve 180 is mounted directly on the shoe housing 12. Therefore, the length of the retard discharge path 210 formed through the front plate 14 to connect the retard oil pressure chamber 51 and the discharge switching valve 180, and the length of the advance discharge path 212 connecting the advance oil pressure chamber 54 and the discharge switching valve 180, are shortened. Thus, the working oil is quickly discharged from each retard oil pressure chamber and each advance oil pressure chamber through the discharge switching valve 180. When controlling the phase, the working fluid is quickly discharged from the retard oil pressure chambers or the advance oil pressure chambers and, therefore, the working oil can be supplied quickly to the advance oil pressure chambers or the retard oil pressure chambers, as the case may be. As a result, the phase control response is improved.

Fourth Embodiment

Figure 10:
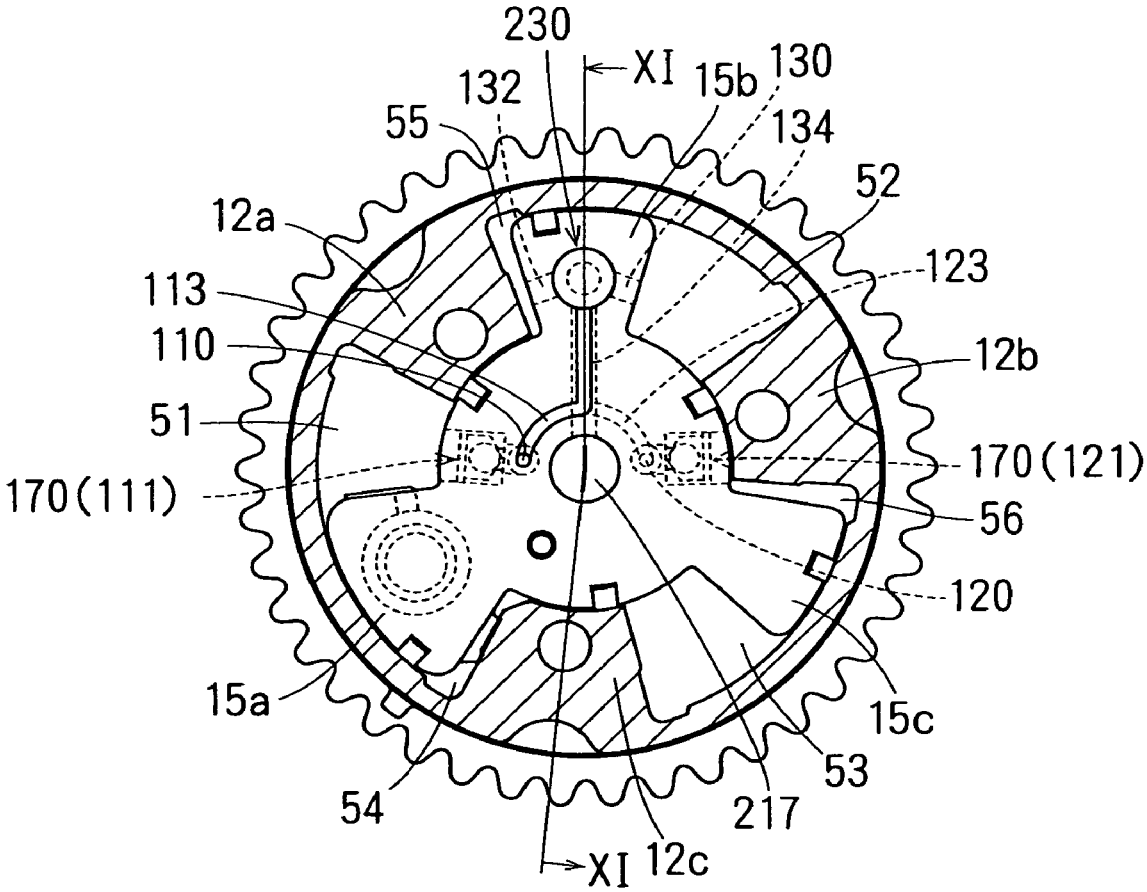
FIG. 10 is a sectional view of a valve timing regulating apparatus cut away along an inner side of a front plate, according to a fourth embodiment of the present invention.
Figure 11:
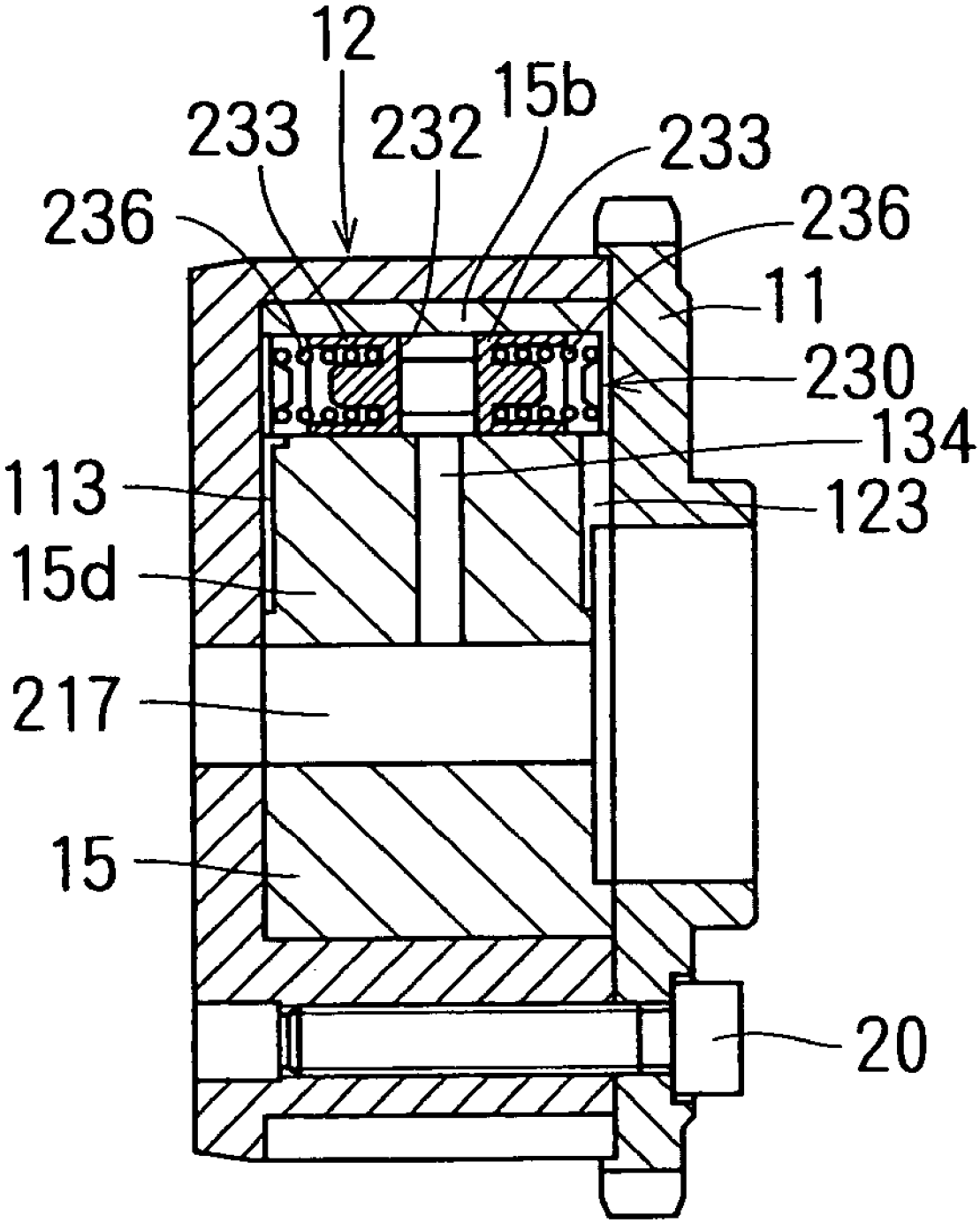
FIG. 11 is a sectional view taken along line XI—XI in FIG. 10.
Figure 12:
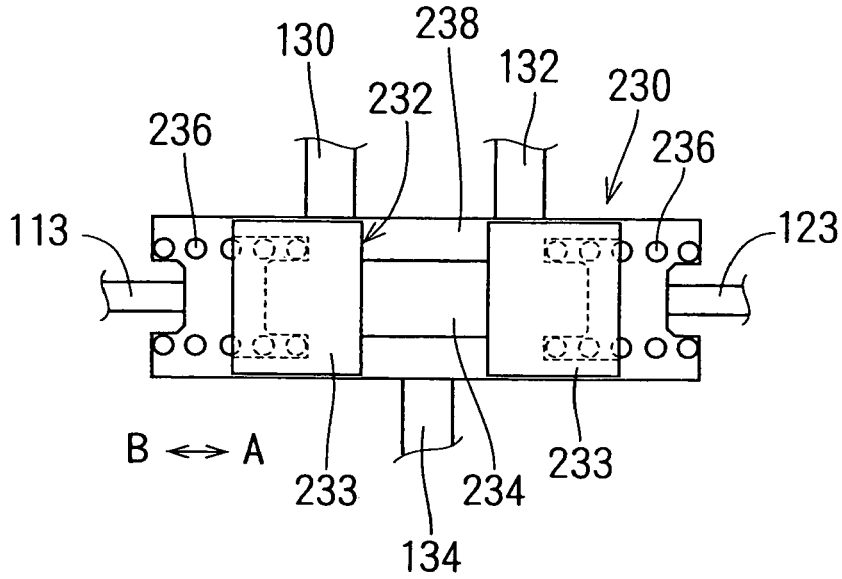
FIG. 12 is a diagram for explaining a discharge switching valve according to the fourth embodiment.

A fourth embodiment of the invention is shown in FIGS. 10 to 12. The component parts substantially identical to the corresponding ones of the first and second embodiments are designated by the same reference numerals, respectively.

According to the fourth embodiment, a discharge switching valve 230 making up a mechanical spool valve is arranged in a vane 15*b*. As shown in FIG. 12, the discharge switching valve 230 includes a spool 232 and springs 236. The spool 232 has a pair of large-diameter portions 233 arranged on the two sides along the direction of reciprocation of the spool 232 and a small-diameter portion 234 arranged at the central portion of the spool 232 to connect the large-diameter portions 233 to each other. The springs 236 urge the large-diameter portions 233 in opposite directions of reciprocation. The retard oil pressure chambers communicate with each other downstream of the check valve 170, and so do the advance oil pressure chambers.

As shown in FIGS. 10 and 11, a retard control path 113 is formed to communicate with a retard supply path 110 on the front plate 14 side of the vane rotor 15. The retard control path 113 is formed to extend from an arcuate portion formed on a front plate 14 side end surface of the boss 15*d* to the end surface of one of the large-diameter portions 233 of the spool 232. An advance control path 123 is formed to communicate with an advance supply path 120 on a chain sprocket 11 side of the vane rotor 15. The advance control path 123 is formed to extend from an arcuate portion formed on the chain sprocket 11 side end surface of the boss 15*d* to the end surface of the other large-diameter portion 233 of the spool 232. A discharge path 134 communicates with an annular chamber 238 formed around the small-diameter portion 234 of the spool 232, and extends from the annular chamber 238 through the vane rotor 15 toward a drain port 217.

At the time of phase retard control by supplying the working oil to each retard oil pressure chamber from the retard supply path 110, the working oil flows from the retard supply path 110 to the retard control path 113 and, therefore, the spool 232 moves in the direction of arrow A in FIG. 12. Then, the first large-diameter portion 233 cuts off the communication between the retard discharge path 130 and the annular chamber 238, and the second large-diameter portion 233 establishes communication between the advance discharge path 132 and the annular chamber 238. Thus, the discharge of the working oil from the retard oil pressure chamber 52 is prohibited, so that the working oil is discharged to the drain 100 from the advance oil pressure chamber 55 through the discharge switching valve 230.

At the time of phase advance control by supplying the working oil to each advance oil pressure chamber from the advance supply path 120, on the other hand, the working oil flows from the advance supply path 120 to the advance control path 123 and, therefore, the spool 232 moves in the direction of arrow B in FIG. 12. Then, the second large-diameter portion 233 cuts off the communication between the advance discharge path 132 and the annular chamber 238, and the first large-diameter portion 233 establishes communication between the retard discharge path 130 and the annular chamber 238. Thus, the retard discharge path 130 communicates with the retard oil pressure chamber 52, and the advance discharge path 132 communicates with the advance oil pressure chamber 55. As a result, the discharge of the working oil from the advance oil pressure chamber 55 is prohibited, so that the working oil is discharged to the drain 100 from the retard oil pressure chamber 52 through the discharge switching valve 230.

Once the target phase is reached, the working oil ceases to be supplied to the retard control path 113 and the advance control path 123. Therefore, by the urging force of the springs 236 acting on the spool 232 in opposite directions, the spool 232 is held at the intermediate position indicated in FIG. 12. In the process, the two large-diameter portions 233 cut off the communication between the retard discharge path 130/the advance discharge path 132 and the annular chamber 248 and, therefore, no working oil is discharged to the drain 100 from each retard oil pressure chamber and each advance oil pressure chamber.

According to the fourth embodiment, the discharge switching valve 230 making up a mechanical spool valve is arranged in the vane 15*b*. Therefore, both the length of the retard discharge path 130 connecting the retard oil pressure chamber 52 and the discharge switching valve 230 and the length of the advance discharge path 132 connecting the advance oil pressure chamber 55 and the discharge switching valve 230 are shortened. As a result, at the time of phase control, the working fluid is quickly discharged from the retard oil pressure chambers or the advance oil pressure chambers, so that the working oil can be quickly supplied to the advance oil pressure chambers or the retard oil pressure chambers, as the case may be. Thus, the phase control response is improved.

Fifth Embodiment

Figure 13:
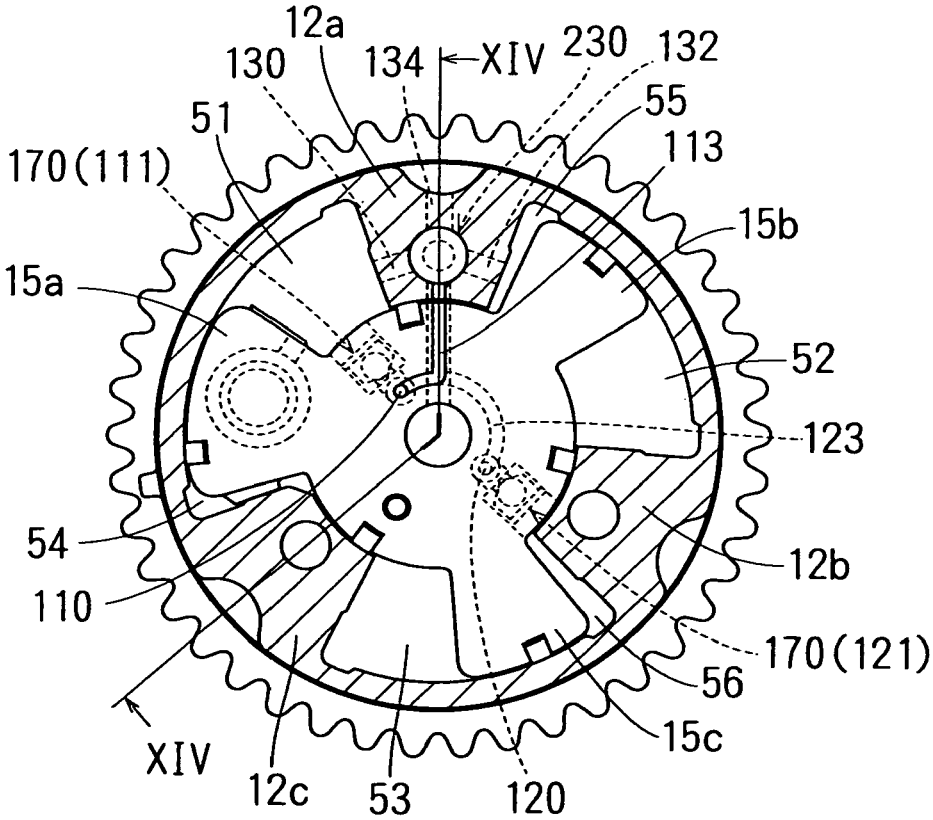
FIG. 13 is a sectional view of a valve timing regulating apparatus cut away along an inner side of a front plate according to a fifth embodiment of the present invention.
Figure 14:
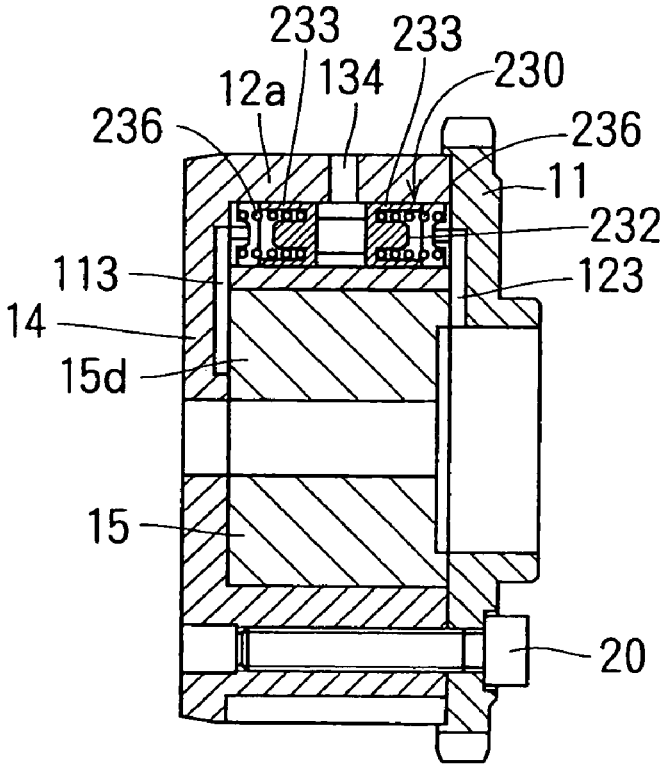
FIG. 14 is a sectional view taken along line XIV—XIV in FIG. 13.

A fifth embodiment of the invention is shown in FIGS. 13 and 14. In the fifth embodiment, substantially the same component parts as those in the fourth embodiment are designated by the same reference numerals, respectively.

According to the fifth embodiment, a discharge switching valve 230 having substantially the same configuration as the corresponding valve in the fourth embodiment is arranged in the shoe 12*a*. Also, the retard oil pressure chambers communicate with each other downstream of the check valve 170, and so do the advance oil pressure chambers.

As shown in FIGS. 13 and 14, the retard control path 113 is formed to communicate with the retard supply path 110 on the inner side surface on the vane rotor 15 side of the front plate 14. The retard control path 113 is formed to extend from an arcuate portion formed on the inner side surface of the front plate 14 facing the boss 15*d* to the end surface of the first large-diameter portion 233 of the spool 232. The advance control path 123 is formed to communicate with the advance supply path 120 on the inner side surface on the vane rotor 15 side of the chain sprocket 11. The advance control path 123 is formed to extend from an arcuate portion formed on the inner end surface of the chain sprocket 11 facing the boss 15*d* to the end surface of the second large-diameter portion 233 of the spool 232. The retard discharge path 130 communicates with the retard oil pressure chamber 51, and the advance discharge path 132 communicates with the advance oil pressure chamber 55. The discharge path 134 extends from the discharge switching valve 230 diametrically outward of the shoe 12*a*, and establishes communication between the annular chamber 238 formed around the small-diameter portion 234 of the spool 232 and the outside of the shoe housing 12. The operation of the discharge switching valve 230 at the time of phase control operation is similar to that of the fourth embodiment.

According to the fifth embodiment, the discharge switching valve 230 making up a mechanical spool valve is arranged in the shoe 12*a*. Therefore, both the length of the retard discharge path 130 connecting the retard oil pressure chamber 51 and the discharge switching valve 230 and the length of the advance discharge path 132 connecting the advance oil pressure chamber 55 and the discharge switching valve 230 are shortened. As a result, at the time of phase control, the working fluid is quickly discharged from the retard oil pressure chambers or the advance oil pressure chambers and, therefore, the working oil can be quickly supplied to the advance oil pressure chambers or the advance oil pressure chambers, as the case may be. Thus, the phase-control response is improved.

Sixth Embodiment

Figure 15:
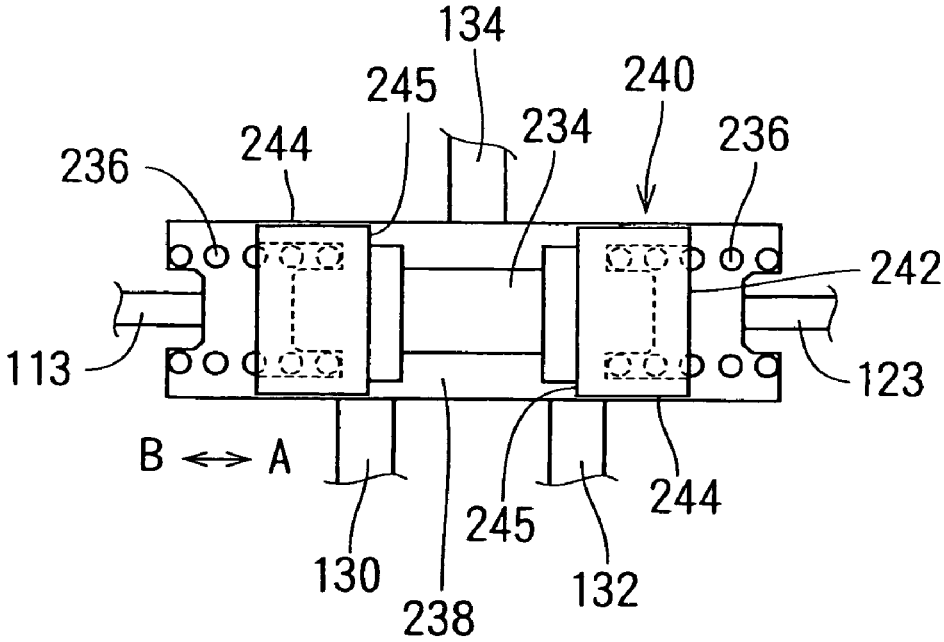
FIG. 15 is a diagram for explaining a discharge switching valve according to a sixth embodiment of the present invention.

A sixth embodiment of the invention is shown in FIG. 15. Substantially the same component parts as those in the fourth embodiment are designated by the same reference numerals, respectively.

A discharge switching valve 240 making up a mechanical spool valve is formed with steps 245 having a diameter intermediate between large-diameter portions 244 and a small-diameter portion 234, on the small-diameter portion 234 side of each large-diameter portion 244, in place of the large-diameter portions 233 of the discharge switching valve 230 explained in the fourth embodiment.

At the time of phase retard control, the first large-diameter portion 244 cuts off the communication between the retard discharge path 130 and the annular chamber 238, and establishes the communication between the advance discharge path 132 and the annular chamber 238. At the time of phase advance control, on the other hand, the second large-diameter portion 244 cuts off the communication between the advance discharge path 132 and the annular chamber 238 and establishes communication between the retard discharge path 130 and the annular chamber 238.

Once the target phase is reached, the working oil ceases to be supplied to the retard control path 113 and the advance control path 123 and, therefore, a spool 242 is held at the intermediate position indicated in FIG. 15 by the urging force of a pair of the springs 236 acting on the spool 242 in opposite directions. In the process, in view of the fact that the steps 245 are formed on the small-diameter portion 234 side of each large-diameter portion 244, the retard discharge path 130 and the advance discharge path 132 communicate with the discharge path 134 through the annular chamber 238 at an intermediate position shown in FIG. 15. While the phase is held, therefore, the working oil is discharged little by little to the drain 100 from each retard oil pressure chamber and each advance oil pressure chamber.

Due to a machining error of the spool of the discharge switching valve making up a mechanical spool valve or the error of the urging force of the springs, the spool may be displaced from the intermediate position and only one of the retard discharge path 130 and the advance discharge path 132 communicates with the discharge path 134. Then, the working oil leaks out to the drain 100 from only the retard oil pressure chambers or only the advance oil pressure chambers. At the time of phase holding control, therefore, the vane rotor 15 cannot be held at the target phase.

In view of this, according to the sixth embodiment, even in the case where the large-diameter portions 244 are displaced slightly in the direction of arrow A or B from the intermediate position shown in FIG. 15, while the phase is held, due to the machining error of the spool 242 or the error of the urging force of the springs 236, the retard discharge path 130 and the advance discharge path 132 communicate with the annular chamber 238. With this configuration, while the phase is held, the working oil, though in small amount, leaks out to the drain 100 from the two oil pressure chambers including the retard oil pressure chambers and the advance oil pressure chambers. As a result, even in the case where the spool is moved slightly from the intermediate position due to the machining error of the spool 242 or the error of the urging force of the springs 236, the working oil flows out to the discharge side from both the retard oil pressure chambers and the advance oil pressure chambers and, therefore, the effects of the error can be compensated for. Thus, the phase holding robustness is improved and the vane rotor 15 can be held easily at the target phase.

In the plurality of the embodiments of the invention described above, check valves for blocking the reverse flow of the working oil to the oil pump 102 are arranged in the supply paths for supplying the working oil to each retard oil pressure chamber and each advance oil pressure chamber. Even in the case where the vane rotor 15 receives a torque variation from the camshaft 2, therefore, the vane rotor 15 is prevented from returning to the side opposite to the target phase at the time of phase control. As a result, the target phase can be quickly reached.

Also, the supply switching valve capable of selectively switching the communication between each retard oil pressure chamber and the oil pump 102 and the communication between each advance oil pressure chamber and the oil pump 102 is configured as an entity separate from the discharge switching valve capable of selectively switching the communication between each retard oil pressure chamber and the drain 100 and the communication between each advance oil pressure chamber and the drain 100. Therefore, the number of paths connected to each of the supply switching valve and the discharge switching valve is reduced. As a result, the supply switching valve and the discharge switching valve can be each reduced in size.

OTHER EMBODIMENTS

In the plurality of the embodiments described above, the retard supply path 110 and the advance supply path 120 branch off downstream of the check valve arranged in the retard supply path 110 and the advance supply path 120 to supply the working oil to each retard oil pressure chamber and each advance oil pressure chamber. Even in the case where the vane rotor 15 receives a torque variation from the camshaft 2, however, the working oil can be prevented from flowing in reverse direction to the oil pump 102 from each retard oil pressure chamber and each advance oil pressure chamber, by arranging a check valve in at least one retard supply path 110 branched to supply the working oil to each retard oil pressure chamber and in at least one advance supply path 120 branched to supply the working oil to each advance oil pressure chamber.

Also, in the plurality of the embodiments described above, the control pressure for the discharge switching valve is introduced from the downstream of the sliding portion between the camshaft 2 and the bearing 3 in the supply path. As an alternative, the control pressure may be introduced from the upstream of the sliding portion between the camshaft 2 and the bearing 3 in the supply path. As another alternative, the control pressure for the discharge switching valve may be introduced from the downstream of the check valve in the supply path. Further, although the switching operation of the discharge switching valve is controlled by the oil pressure of the retard supply path 110 and the advance supply path 120, the discharge switching valve of electromagnetic drive type may alternatively be employed to control the switching operation based on the control signal from a control unit such as an ECU.

The plurality of the embodiments described above refer to the vane-type valve timing regulating apparatus. This invention may also be applied, however, to a valve timing regulating apparatus in which a driving rotary member and a driven rotary member are coupled to each other by means of helical teeth. In the valve timing regulating apparatus in which a driving rotary member and a driven rotary member are coupled to each other by means of helical teeth, one rotary member is moved along the rotational axis with respect to the other rotary member by controlling the pressure of the working fluid in the retard chamber and the advance chamber, and the driven rotary member is rotated relatively, with respect to the driving rotary member, along the helical teeth.

Also, unlike the plurality of the embodiments described above configured to transmit the rotary drive force of the crankshaft to the camshaft by the chain sprocket, a configuration including a timing pulley or a timing gear can alternatively be employed. Also, the driving force of the crankshaft as a driving shaft may be received by the first vane rotor, the camshaft making up a driven shaft and the first housing may be rotated integrally with each other.

In the above-mentioned plurality of the embodiments, the stopper piston is moved axially and is fitted in the fitting ring. As an alternative, the stopper pin may be moved in radial direction and fitted in the fitting ring. Also, instead of restricting the rotation of the vane rotor 15 relative to the housing 10 by the restriction means including the stopper piston 31, the fitting ring 36 and the spring 37, the valve timing regulating apparatus may be configured to have no such restriction means.

While the invention has been described by reference to specific embodiments chosen for the purposes of illustration, it should be apparent that numerous modifications could be made thereto by those skilled in the art without departing from the basic concept and scope of the invention.

The invention claimed is:

1. A valve timing regulating apparatus arranged in a drive force transmission system for transmitting the drive force from a driving shaft of an internal combustion engine to a driven shaft for operating, opening and closing, at least one of an intake valve and an exhaust valve thereby to regulate operation timing of the opening and closing of at least one of the intake valve and the exhaust valve, comprising:

a driving rotary member rotated by the drive force of the driving shaft;

a driven rotary member relatively rotated to a retard side and a advance side with respect to the driving rotary member by pressure of working fluid of a retard chamber and an advance chamber thereby to transmit the drive force of the driving shaft to the driven shaft;

a supply switching valve arranged in a supply path for supplying working fluid from a fluid source to the retard chamber and the advance chamber and capable of selectively switching communication only either between the retard chamber and the fluid source or between the advance chamber and the fluid source;

a check valve arranged in the supply path for allowing working fluid to flow from the fluid source to the retard chamber and the advance chamber and prohibiting a flow of working fluid from the retard chamber and the advance chamber to the fluid source; and a discharge switching valve configured as a member independent of the supply switching valve and arranged in a discharge path for discharging working fluid from the retard chamber and the advance chamber, the discharge switching valve being capable of selectively switching communication only either between the retard chamber and a fluid discharge side or between the advance chamber and a fluid discharge side, and wherein the discharge switching valve communicates the fluid discharge side with the chamber other than the chamber with which the fluid source is communicated by the supply switching valve.

2. A valve timing regulating apparatus according to claim 1, wherein one of the driving rotary member and the driven rotary member is a first housing having a first accommodation chamber formed within a predetermined rotational angle range; and wherein the other of the driving rotary member and the driven rotary member is a first vane rotor having a first vane partitioning the first accommodation chamber into the retard chamber for driving the driven rotary member to a retard side and the advance chamber for driving the driven rotary member to an advance side, the first vane rotor being rotationally driven relatively with respect to the housing by the pressure of the working fluid of the retard chamber and the advance chamber.

3. A valve timing regulating apparatus according to claim 2, wherein the check valve is arranged on the first vane rotor.

4. A valve timing regulating apparatus according to claim 2, wherein the discharge switching valve is a spool valve with a spool adapted to reciprocate under pressure of working fluid and capable of selectively switching communication between the retard chamber and a fluid discharge side and communication between the advance chamber and a fluid discharge side, the spool valve being arranged on the first vane rotor.

5. A valve timing regulating apparatus according to claim 2, wherein the discharge switching valve is a spool valve with a spool adapted to reciprocate under pressure of working fluid and capable of selectively switching communication between the retard chamber and a fluid discharge side and communication between the advance chamber and a fluid discharge side, the spool valve being arranged on the first housing.

6. A valve timing regulating apparatus according to claim 1, wherein the discharge switching valve is a spool valve with the spool adapted to reciprocate under pressure of working fluid and capable of selectively switching communication between the retard chamber and a fluid discharge side and communication between the advance chamber and a fluid discharge side.

7. A valve timing regulating apparatus according to claim 6, wherein when the spool is located at a neutral position, working fluid in the retard chamber and the advance chamber leaks from the discharge switching valve to a discharge side.

8. A valve timing regulating apparatus according to claim 6, wherein switching operation of the discharge switching valve is controlled by pressure of working fluid in the supply path.

9. A valve timing regulating apparatus according to claim 8, wherein the switching operation of the discharge switching valve is controlled by pressure of fluid in the supply path between the supply switching valve and the check valve.

10. A valve timing regulating apparatus according to claim 1, wherein the discharge switching valve includes a second housing having a second accommodation chamber formed in a predetermined rotational angle range and a second vane rotor having a second vane partitioning the second accommodation chamber into two pressure chambers, the second vane rotor being rotated relatively with respect to the second housing by pressure of working fluid in at least one of the pressure chambers.

11. A valve timing regulating apparatus according to claim 1, wherein the supply path supplies working fluid to the retard chamber and the advance chamber from a bearing of the driven shaft through the driven shaft, and the check valve is arranged downstream of the bearing and in the supply path.

12. A valve timing regulating apparatus according to claim 1, wherein the supply switching valve has a blocking position that blocks communication between the retard chamber and the fluid source and blocks communication between the advance chamber and the fluid source, the discharge switching valve has a blocking position that blocks communication between the retard chamber and the fluid discharge side and blocks communication between the advance chamber and the fluid discharge side, and when the supply switching valve is in said blocking position thereof, the discharge switching valve is in said blocking position thereof.

* * * * *